United States Patent [19]

Nelson et al.

[11] Patent Number: 4,796,792

[45] Date of Patent: Jan. 10, 1989

[54] APPARATUS FOR CUTTING WRAPPING PAPER

[75] Inventors: Robert A. Nelson, Elk River; Carroll C. Altman, Maple Grove, both of Minn.

[73] Assignee: Kwik-File, Inc., Golden Valley, Minn.

[21] Appl. No.: 77,123

[22] Filed: Jul. 23, 1987

[51] Int. Cl.[4] ..... B26F 3/02

[52] U.S. Cl. ..... 225/72; 225/85

[58] Field of Search ..... 225/67, 72, 85-87, 225/89, 43, 51, 90

[56] References Cited

U.S. PATENT DOCUMENTS

| | | |
|---|---|---|
| Re. 17,092 | 10/1928 | Marcuse . |
| 440,928 | 11/1890 | Schenck . |
| 671,083 | 4/1901 | Hull . |
| 834,540 | 10/1906 | Vandeven . |
| 936,354 | 10/1909 | Proctor et al. . |
| 1,040,845 | 10/1912 | Baber . |
| 1,212,068 | 1/1917 | Jones et al. . |
| 1,389,003 | 8/1921 | Huff . |
| 1,631,776 | 6/1927 | Sunday . |
| 2,152,031 | 3/1939 | Currier . |
| 2,272,628 | 2/1942 | Anderson . |
| 3,228,578 | 1/1966 | Waltz . |
| 3,384,280 | 5/1968 | Summersby . |
| 3,713,569 | 1/1973 | Dashnier et al. . |
| 3,731,863 | 5/1973 | Nausedas . |
| 4,085,878 | 4/1978 | Nausedas . |

FOREIGN PATENT DOCUMENTS 336119 6/1930 United Kingdom ..... 225/72

OTHER PUBLICATIONS

Exhibit A illustrating "Mailflow Systems, Sorters".
Exhibit B photographs illustrating cartridge for cutting table having retainer.

*Primary Examiner*—Frank T. Yost
*Assistant Examiner*—Michael D. Folkerts
*Attorney, Agent, or Firm*—Merchant, Gould, Smith, Edell, Welter & Schmidt

[57] ABSTRACT

An apparatus for cutting wrapping paper is provided. The apparatus is adapted for use in association with a countertop, such as a surface of a workbench or the like. The apparatus includes a retention or retainer mechanism and a knife blade mechanism which are mounted in association with a feed slot in the countertop surface. Paper fed from a roll of paper stored underneath the countertop extends upwardly through the feed slot. The retention mechanism, preferably through means of a floating retainer member, pinches an extension of the paper against a wall of the feed slot, to prevent the paper from falling downwardly through the feed slot during apparatus use. The preferred retainer member comprises a circular rod maintained in an operable position by means of a ramp member. The preferred apparatus includes a hinged knife blade arrangement selectively orientable in a first, horizontal, storage position and a second, substantially vertical, cutting position.

8 Claims, 1 Drawing Sheet

APPARATUS FOR CUTTING WRAPPING PAPER

FIELD OF THE INVENTION

The present invention relates to cutting devices, and in particular to devices for cutting paper. Specifically, the invention concerns countertop or tabletop systems wherein a feeder roll of paper is disposed below a work surface, and a knife blade or cutting blade is mounted on or in the work surface.

BACKGROUND OF THE INVENTION

Wrapping paper is generally dispensed from large rolls. The paper may be of a variety of types; for example, decorative paper used for wrapping gifts and heavier paper used for wrapping packages to be mailed. The paper may be of a variety of weights and colors, and may include a variety of coatings thereon.

The paper is generally dispensed from rolls from which a selected length is cut for a wrapping operation. In many systems, a paper roll is mounted on a rotatable axle or the like, for ease of unrolling. Cutting may be by means of a knife, scissors or similar arrangement.

A variety of cutting devices have been provided in the prior art. In some of these an elongate stationary knife blade edge has been provided, against which an extension of paper from a feeder roll can be pulled, to cut same.

Countertop systems have been developed in which the paper feeder roll is positioned underneath the countertop. A length of paper fed from the roll may be threaded into proximity with a knife blade edge mounted on or near the counter top. The knife blade edge facilitates cutting.

A problem with such arrangements has been that once a piece of paper has been cut off the roll, the remaining extension of paper on the roll may slip downwardly toward the roll, becoming inaccessible from the top of the counter. In other instances, while the paper might not fall downwardly, only a relatively small extension of paper may be left extending above the countertop; the paper extension being in the immediate vicinity of the knife blade edge. Such an extension of paper may be relatively difficult to grasp, and due to its proximity to the knife blade edge injury to a user may be likely.

Another problem with previous arrangements has been with the knife blade orientation. The useful knife blade edge for cutting is often also a potentially hazardous projection or an obstruction to full and efficient use of a work surface.

Wrapping paper comes in rolls of various widths, as well as lengths. It will be preferred that any cutting apparatus developed be readily able to accomodate papers of various widths.

OBJECTS OF THE INVENTION

Therefore, the objects of the present invention are:

to provide a preferred paper cutting arrangement utilizable in association with a countertop surface;

to provide such an arrangement which includes a feed slot in a countertop, through which paper is vertically fed from a storage or feeder roll;

to provide such an arrangement having means inhibiting an extension of the roll of paper feed from dropping back through the feed slot, after a cutting operation;

to provide means whereby a substantial extension of paper, from the feeder roll, selectively remains extending above the countertop surface after a cutting operation;

to provide means whereby a knife blade edge is provided to facilitate cutting;

to provide means whereby the knife blade edge is selectively retractable between cutting operations, to a position of relative convenience and security;

to provide such an arrangement whereby an extension of paper left above the countertop is oriented out of immediate proximity to a retracted knife blade edge;

to provide such an apparatus which is readily adaptable for use in association with rolls of paper of various widths and lengths;

to provide such an apparatus which is relatively inexpensive to produce; and to provide such an apparatus which is relatively easy to manufacture, simple to use, and which is particularly well adapted for the proposed usages thereof.

Other objects and advantages of this invention will become apparent from the following descriptions, taken in connection with the accompanying drawings, wherein are set forth by way of illustration and example certain embodiments of the present invention.

SUMMARY OF THE INVENTION

An apparatus or arrangement is provided for cutting paper such as wrapping paper or the like. The apparatus is adapted for cutting of paper, as fed from feeder rolls, across a width thereof; that is for cutting generally in a direction parallel to a longitudinal axis of the feeder roll. The apparatus is particularly adapted for use in a countertop or tabletop system and is well-adapted for use in both stationary and mobile counter systems.

The preferred apparatus includes a countertop portion having an upper surface and an elongate transverse slot. The apparatus preferably includes means for mounting a feeder roll of paper underneath the tabletop, with an extension thereof projecting upwardly through the transverse feeder slot. The feeder roll may be mounted upon an axle system positioned beneath the counter, or in some instances the feeder roll may simply be set within a corresponding storage compartment. Generally, an axle arrangement will be preferred for ease of handling.

The present invention includes a knife blade arrangement or mechanism and a paper retainer mechanism means preferably comprising a paper retainer or retention mechanism mounted in association with the feed slot. The knife blade arrangement provides an edge against which paper can be pulled, to facilitate cutting. The retainer mechanism operates to prevent paper extending off the feeder roll from falling downwardly through the feed slot, after a cutting operation. Preferably, the retainer mechanism and knife blade mechanism cooperate so as to provide a readily and relatively safely graspable extension of paper above the countertop after each cutting operation.

The retainer mechanism of the preferred embodiment comprises two primary components: a ramp member and a retainer member. The ramp member extends downwardly through the feed slot, from a side of the transverse feed slot across and toward an opposite sidewall of the feed slot. Enough space is left between the preferred ramp member and the opposite sidewall of the feed slot to permit the paper to be readily fed therebetween. However, preferably the gap between the ramp member and the opposite sidewall is sufficiently small to prevent the retainer member from passing therebetween.

The preferred retainer member comprises an elongate rod having friction members, such as rubber grommets or rings thereon. The retainer member is operatively positioned within the transverse feed slot, within a recess formed by the ramp member and the opposite sidewall. The preferred retainer member is free floating. However, due to the slope of the ramp member, the rest position for the retainer member is toward or against the feed slot sidewall.

In operation, paper is fed from the feed roll between the retainer member and the feed slot sidewall. Generally, friction from the retainer member against the paper, and pressing of the paper against the feed slot sidewall, prevents the paper from falling downwardly through the feed slot, even when only a relatively short extension of paper projects above the retainer member. Frictional, non-slipping, contact between the retainer member and the paper is facilitated by friction surface means in association with the retainer member. Frictional contact is further facilitated by the downward slope of the ramp member generally directing the free floating retainer member against the paper and the feed slot sidewall.

When a portion of paper extending above the retainer member is pulled upwardly, the retainer member is also pulled upwardly, and is directed away from pinching the paper against the sidewall. As a result, the paper is readily fed upwardly through the feed slot. However, once the paper is cut and/or released, upward tension on the retainer member stops, and the retainer member settles back into the rest position, pinching the paper against the feed slot sidewall. In this position the retainer member prevents the paper from falling downwardly through the feed slot.

In the preferred arrangement, the free floating retainer member is prevented from being pulled vertically completely outwardly from the feed slot by retaining means preferably comprising stays or retainer tabs. These tabs may be, for example, extensions mounted on the ramp member above the retainer member.

The preferred apparatus includes a knife blade member mounted in association with the feed slot, and positioned above the retainer mechanism. The preferred knife blade member comprises a hinged plate mounted as a cover extending over the feed slot. The hinged plate includes a first side member mounted to extend partially over the feed slot from an anchoring point substantially adjacent a wall of the feed slot. A second hinge member is pivotable, by means of the hinge, from a horizontal position extending substantially completely across the feed slot, to a vertical position. An outer edge of the second hinge member preferably includes a knife blade thereat which, preferably, is oriented to extend generally vertically when the second hinge member is oriented vertically. The preferred hinge member includes biasing means associated therewith, generally retaining the hinge member, when at rest and not under tension, in a closed position, i.e., oriented with the second hinge member extending generally horizontally. The preferred knife blade edge is serrated.

As will be understood from the detailed descriptions and the drawings, with such an arrangement as the paper from the feed roll is pulled generally upwardly, the knife blade edge is selectively pivoted to the vertical position. Pivoting of the knife blade edge is facilitated by its serrated design, which grabs the paper somewhat. After a selected amount of paper is fed through the slot, it can be readily torn against the knife blade edge, for cutting. The tearing is also facilitated by the serrated design.

Once tension is released from the cut paper, two important adjustments in the apparatus occur. For one, the retainer member settles into a position preventing the paper from being retracted through the feed slot. For the other, the vertically extending knife blade edge folds back into a horizontal position. The result, for the preferred embodiment, is that the knife blade edge is generally recessed within the feed slot and is out of a potentially hazardous vertical projection. Further, a substantial extension of paper is left projecting above the countertop. This extension can be readily grasped for the next cutting operation. Also, as a result of the preferred arrangement, the extension of paper above the countertop is oriented, relative to the knife blade edge, such that it can be readily grasped without substantial risk of harmful contact with the knife blade.

The drawings constitute a part of this specification and include exemplary embodiments of the present invention while illustrating various objects and features thereof. In some instances, relative material thicknesses, or component sizes, may be shown exaggerated to facilitate understanding of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed structure.

Figure 1:
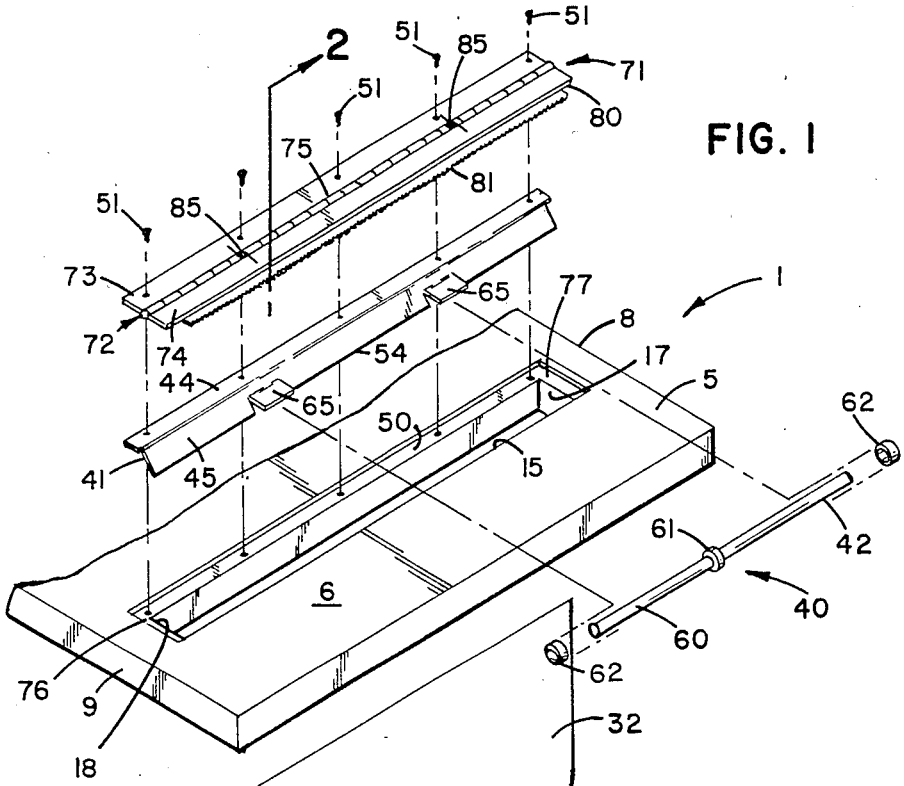
FIG. 1 is a fragmentary, exploded, perspective view of a paper cutting apparatus according to the present invention, shown in association with a countertop and with a roll of feed paper in association therewith.

The reference numeral 1, FIG. 1, generally designates a cutting apparatus according to the present invention.

The apparatus 1 may be utilized in association with a variety of cutting surfaces, such as a stationary countertop or a surface of a movable cart or the like. In FIG. 1, apparatus 1 is shown at use in association with a stationary countertop 5. Countertop 5 has an upper surface 6, a lower surface 7, a first side edge 8 and a second side edge 9. For preferred embodiments of the present invention, upper surface 6 is a relatively smooth flat work surface generally free of obstructions, upon which a work operation such as a wrapping operation can be readily undertaken.

Countertop 5 includes an elongate feed slot 15 therein. For the preferred embodiment, feed slot 15 is transverse, that is it generally extends transversely between edges 8 and 9. The preferred feed slot 15 does not extend completely between the two side edges 8 and 9, but rather it includes first and second end walls 17 and 18, respectively.

Figure 2:
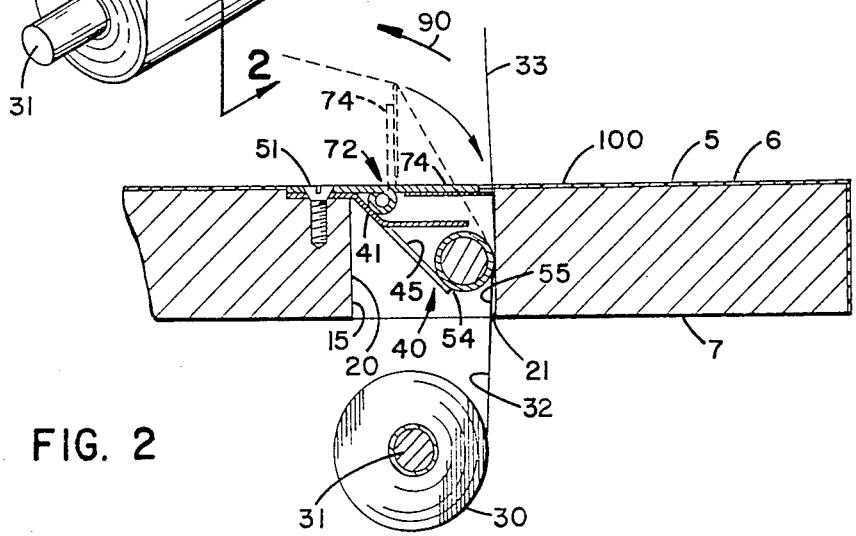
FIG. 2 is an enlarged, fragmentary, cross-sectional view taken generally along line 2—2 in FIG. 1, with phantom lines indicating component positions during a step of operation.

Referring to FIG. 2, feed slot 15 defines first and second opposite sidewalls 20 and 21, respectively. Paper from a paper roll is fed between sidewalls 20 and 21, as described below.

In FIGS. 1 and 2, a roll of paper 30 is shown oriented in operable position with respect to assembly 1. In the arrangement shown, roll of paper 30 is mounted upon an axle 31. By such a mount the roll 30 can be easily and conveniently unrolled by pulling on an extension 32 of the paper. The feed mechanism comprising roll 30 and axle 31 may be of any of a variety of conventional designs. For example, the fit between the roll 30 and the axle 31 may be rotational, so that the roll 30 rotates relative to the axle 31, as extension 32 is pulled. On the other hand, axle 31 may itself be rotatably mounted within a conventional bracket system, to facilitate unrolling of the paper. It will be understood that in some applications of the present invention the roll 30 might not be mounted upon an axle system at all, for example roll 30 might merely rest within a storage compartment positioned beneath the countertop 5.

Extension 32 comprises a portion of paper fed or threaded upwardly through feed slot 15. Generally, when a user desires an extension of paper, for use in a wrapping operation or the like, a portion 33 of extension 32 which is above countertop 5 is grasped and pulled generally upwardly, unrolling a desired amount of paper. The needed paper is then cut from the roll 30, leaving a new extension, analogous to extension 32, FIG. 2, trailing downwardly through feed slot 15 to the paper roll 30.

It will be readily understood that in the absence of retaining means according to the present invention, extension 32 could easily fall downwardly through feed slot 15. This would require the next user to reach underneath countertop 5, and rethread extension 32 through feed slot 15, before another cutting operation on top of counter 5 could be undertaken. As a result of retention means according to the present invention, the extension 32 of paper is prevented from falling through feed slot 15, alleviating the above-described problem.

Referring to FIGS. 1 and 2, the retention means according to the present invention comprises a retention mechanism 40. The retention mechanism 40 includes a ramp member 41 and a retainer member 42.

The preferred ramp member 41, FIG. 1, includes a mounting flange 44 and a downwardly extending ramp portion 45. The preferred ramp member 41, FIG. 1, is elongate, substantially extending completely across slot 15 between end walls 17 and 18.

In the preferred embodiment, slot 15 includes a recessed ledge 50 extending along the first sidewall 20, in which mounting flange 44 of the ramp member 41 is received for mounting. Referring to FIG. 2, as a result of the recessed ledge 50, mounting flange 44 is recessed below countertop 5, leaving a countertop which is smooth and substantially free from obstruction. For the embodiment shown, ramp member 41 is mounted by means of screws 51 extending through apertures in mounting flange 44. It will be understood, however, that a variety of mounting means may be utilized in association with the principles of the present invention.

Referring to FIG. 2, ramp portion 45 extends generally downwardly and across slot 15 from the first sidewall 20 toward the second or opposite sidewall 21. Ramp portion 45, however, does not extend completely across slot 15. Rather, it terminates along an edge 54 spaced from sidewall 21 by gap 55. Gap 55 is preferably sized smaller than a diameter or width of retainer member 42, FIG. 2, for reasons that will be understood from descriptions below.

For the preferred embodiment, retainer member 42 is free floating. That is, it is not physically retained in a fixed position, but rather it is free to move along ramp portion 45. For the preferred embodiment, FIG. 1, retainer member 42 comprises an elongate rod or dowel 60. Preferably, rod 60 includes an outer surface of which at least certain portions exhibit a preferred friction engagement with paper. For the rod 60 of FIG. 1, this is provided by means of a rubber strip 61 circumferentially positioned on rod 60, and by rubber end caps or grommets 62.

Referring to FIG. 2, retainer member 42 is operably positioned on an upper surface of ramp portion 45. Under the influence of gravity, retainer member 42 generally slides or rolls along ramp 45 into gap 55, whereat it pinches against side wall 21. Due to its diameter being greater than gap 55, retainer member 42 does not drop downwardly through the gap 55, but rather is supported thereabove by ramp portion 45.

In FIG. 2, paper extension 32 is shown extending upwardly through slot 15 between retainer member 42 and second sidewall 21. It will be readily understood that because of a biasing of retainer member 42 toward sidewall 21, the paper 32 is pinched against the sidewall 21. The result is that paper extension 32 is inhibited from falling or slipping downwardly through feed slot 15, even when extension 32 is released by a user. Generally, retention of paper extension 32 in this orientation is facilitated by friction means such as strip 61 and/or end caps 62 on rod 60. A plurality of strips 61 may be used for increased frictional contact or, more readily to accomodate more than one width of paper roll 30. That is, friction strips such as strip 61 may be oriented such that almost any width of roll utilized can be readily accomodated.

Referring again to FIG. 2, when extension 32 is grasped by a user and is pulled upwardly, tension generally causes retainer member 42 to move upwardly, releasing the pinch on paper 32 and allowing it to be pulled and unrolled from roll 30. However, when upward tension on extension 32 stops, retainer member 42 falls back into gap 55, pinching the paper extension 32.

For the preferred embodiment, means are provided to ensure that retainer member 42 is retained within slot 15 and is not pulled completely outwardly therefrom, by upward tension on paper 32. Referring to FIG. 1, for the preferred embodiment this retaining means comprises at least one stay or tab 65 and preferably a plurality mounted on ramp member 41 in an orientation, FIG. 2, positioned for extension above retainer member 42. The tabs 65 are sufficiently long to inhibit removal of retainer member 42 from slot 15.

A variety of means may be utilized to initially orient retainer member 42 with respect to ramp member 41. For example, the ramp member 41 and retainer member 42 could be mounted within slot 15 substantially simultaneously, or in operative cooperation with respect to one another. In the alternative, tabs 65 could be removably mounted on ramp member 41 by means, not shown, so that they are positionable after retainer member 42 is placed in position. If a bendable metal is used for the structure, tabs 65 can be bent to allow retainer member 42 to be positioned, and then re-bent to an operating position. These latter two types of arrangements would facilitate replacement of retainer member 42 during operation, should same become necessary. For example, various retainer members of different weights or having different friction means thereon might be desirable for use in association with paper rolls of various weights, sizes, coatings or uses. Also, in some instances the retainer member 42 may need to be removed, for cleaning.

The preferred cutting apparatus 1 according to the present invention includes a knife blade mechanism 71 in association therewith. The preferred knife blade mechanism 71 comprises a hinged arrangement 72 having a first hinge plate or member 73 and second hinge plate or member 74. First and second members 73 and 74 are hingedly attached to one another, along hinge 75.

Referring to FIG. 2, first hinge plate 73 is sized to be positioned within recess 50, overlapping ramp mounting flange 44. The first plate 73 comprises a mounting plate by which the knife blade mechanism 71 is mounted through means of screws 51. Referring to FIG. 2, first plate 73 extends partially over, but not completely across, feed slot 15. Recessed edges 75 and 76 provide support of mechanism 71 along its edges.

The second hinge plate 74 includes an outer edge 80 with a cutting blade or knife blade 81 mounted to extend therealong. The cutting blade 81 may be a conventional extension of sharp steel or the like. Preferably blade 81 is serrated, to facilitate cutting and gripping of paper.

Referring to FIG. 2, the cutting blade 81 is oriented to extend substantially completely across feed slot 15, but leaving enough room for the paper extension 32 to extend upwardly between the blade 81 and sidewall 21.

Referring again to FIG. 2, the hinged arrangement 72 is oriented such that second plate 74 is selectively pivotable between first and second positions. In the first position, shown in solid lines in FIG. 2, second plate 74 is substantially horizontal, covering feed slot 15. It is supported in the horizontal position by ledges 75 and 76. In the second position, shown in phantom lines in FIG. 2, second plate 74 extends substantially vertically with the knife blade 81 projecting upwardly.

Preferably, hinged arrangement 72 is of a type which only permits movement of the second plate 74 through the approximate 90° arc indicated in FIG. 2. This can be done by conventional means, for example, ledges 75 and 76 in association with a stop, not shown. Also, preferably hinged arrangement 72 includes biasing means such as springs 85 thereon oriented to generally urge second plate 74 into the first or horizontal position.

Operation of the knife blade mechanism 71 will be understood by reference to FIG. 2. Generally, a user grasps extension 33 and pulls same upwardly and outwardly in the general direction indicated by arrow 90. The tension mechanism 40 operates as previously described, to permit paper roll 30 to be unwound, as pulled. The upward and outward tension against second plate 74 generally lifts same into the vertical position illustrated in phantom lines. This is facilitated by serrations in knife blade 81, which may bite into the paper for initial movement.

When a sufficient length of paper has been obtained, it may be cut against the vertically oriented knife blade edge 81. After cutting, tension on paper extension 32 and roll 30 will have been released. This results in two, substantially simultaneous, readjustments of the assembly 1. The retainer member 42 settles into the pinching position, preventing the paper extension 32 from sliding downwardly through the feed slot 15. Also, without tension of paper extension 32 tending to maintain the second hinge plate 74 in a vertical cutting position, the biasing springs 85 bias the second plate 74 into the first horizontal or storage, position preferably retracting knife blade 81 below the upper surface 6 of the countertop 5.

As a result, an extension or projection of paper is left projecting upwardly from the countertop 5. The extension can be readily grasped for the next cutting operation. The knife blade 81, for the preferred arrangement, is relatively safely and securely oriented beneath countertop 5, out of likely accidental engagement by a user working on the countertop 5 or grasping the extension 32.

For the preferred embodiment illustrated, FIG. 2, preferably hinged arrangement 72 is oriented such that it can lie substantially flush with the countertop upper surface 6, providing a good, convenient, relatively flat work surface, with knife blade 81 recessed below the work surface 6.

As previously indicated, apparatus 1 according to the present invention may be installed in a variety of countertop systems. Referring to FIG. 2, the countertop 5 is a conventional work counter covered by a sheet 100 of material such as plastic or the like. The knife blade mechanism 71 is oriented to lie substantially flat or flush with respect to sheet 100.

It is to be understood that while certain embodiments of the present invention have been illustrated and described, the invention is not to be limited to the specific forms or arrangements of parts herein described and shown.

What is claimed and desired to be secured by Letters Patent is as follows:

1. A paper retainer and cutting assembly for mounting in a countertop feed slot having a sidewall, said assembly comprising:

(a) a retainer mechanism including an elongate rod member and a downwardly extending ramp member;

(i) said ramp member being positionable completely within a countertop feed slot in a manner completely recessed relative to an upper work surface thereof and with said ramp member positioned to extend downwardly toward the feed slot sidewall and partially across the feed slot to a line of termination spaced from the sidewall;

(ii) said elongate rod member being positionable upon said ramp member for being biasing thereby toward the feed slot sidewall;

(b) a knife blade mechanism comprising a hinged arrangement having a first hinge plate and a second hinge plate;

(i) said knife blade mechanism being mountable in the feed slot with the knife blade first and second hinge plates substantially flush with the countertop upper work surface;

(ii) said first hinge plate being a mounting plate and said second hinge plate having an outer edge with a knife blade mounted thereon; said second hinge plate being pivotable between a first horizontal storage position and a second substantially vertical cutting position; and (iii) said knife blade mechanism including biasing means for urging said second hinge plate into said first horizontal position.

2. A paper feed and cutting arrangement comprising:

(a) a substantially planar countertop work surface having a feed slot therein, said feed slot having an elongate sidewall;

(b) a retainer mechanism including a downwardly extending ramp member and a retainer member;

(i) said ramp member being positioned completely within said feed slot and completely recessed relative to said work surface; said ramp member being positioned to extend downwardly toward said feed slot sidewall and partially across said feed slot to terminate along a line spaced from said sidewall;

(ii) said retainer member being positioned upon said ramp member and being biased thereby downwardly toward said feed slot sidewall; and, (c) a knife blade mechanism comprising a hinged arrangement having a first hinge plate and a second hinge plate;

(i) said first hinge plate being a mounting plate and said second hinge plate having an outer edge with a knife blade mounted thereon; said second hinge plate being pivotable between a first horizontal storage position and a second substantially vertical cutting position;

(ii) said knife blade mechanism including biasing means for urging said second hinge plate into said first horizontal position;

(d) whereby an extension of paper fed upwardly through said feed slot is inhibited from slipping downwardly therethrough by said retainer mechanism when said retainer member is oriented to pinch paper against the slot sidewall; and (e) whereby said knife blade mechanism, in operation, will leave an extension of paper projecting upwardly from said countertop work surface, when operated to cut paper fed from said roll by use of said second hinge plate knife blade in said vertical cutting position.

3. A paper feed and cutting arrangement comprising:

(a) a countertop having a substantially planar work surface and having a feed slot therein, said feed slot having an elongate sidewall;

(b) a retainer mechanism including an elongate rod member and a downwardly extending ramp member;

(i) said ramp member being positioned completely within said feed slot and completely recessed relative to said work surface; said ramp member being positioned to extend downwardly toward said feet slot sidewall and partially across said feed slot to termination along a line spaced from said sidewall;

(ii) said elongate rod member being positioned upon said ramp member and being biased thereby downwardly toward said feed slot sidewall; and, (c) a knife blade mechanism comprising a hinged arrangement having a first hinge plate and a second hinge plate;

(i) said knife blade mechanism being mounted in said feed slot with said knife blade first and second hinge plates substantially flush with said countertop work surface;

(ii) said first hinge plate being a mounting plate and said second hinge plate having an outer edge with a knife blade mounted thereon; said second hinge plate being pivotable between a first horizontal storage position and a second substantially vertical cutting position;

(iii) said knife blade mechanism including biasing means for urging said second hinge plate into said first horizontal position;

(d) whereby an extension of paper fed upwardly through said feed slot is inhibited from slipping downwardly therethrough by said retainer mechanism when said rod member is oriented to pinch paper against the slot sidewall; and, (e) whereby said knife blade mechanism, in operation, will leave an extension of paper projecting upwardly from said countertop work surface, when operated to cut paper fed from said roll by use of said second hinge plate knife blade in said vertical cutting position.

4. An arrangement according to claim 3 wherein said elongate rod member includes friction surface means thereon.

5. A paper feed and cutting arrangement comprising:

(a) a countertop having a substantially planar work surface and having a feed slot therein, said feed slot having an elongate sidewall;

(b) a feed roll of paper positioned underneath said countertop work surface and oriented to feed paper therefrom upwardly through said feed slot and adjacent said feed slot elongate sidewall;

(c) a retainer mechanism including an elongate rod member and a downwardly extending ramp member;

(i) said ramp member being positioned completely within said feed slot and completely recessed relative to said work surface; said ramp member being positioned to extend downwardly toward said feed slot sidewall and partially across said feed slot to termination along a line spaced from said sidewall;

(ii) said elongate rod member being positioned upon said ramp member and being biased thereby downwardly toward said feed slot sidewall; and, (d) a knife blade mechanism comprising a hinged arrangement having a first hinge plate and a second hinge plate;

(i) said knife blade mechanism being mounted in said feed slot with said knife blade first and second hinge plates substantially flush with said countertop work surface;

(ii) said first hinge plate being a mounting plate and said second hinge plate having an outer edge with a knife blade mounted thereon; said second hinge plate being pivotable between a first horizontal storage position and a second substantially vertical cutting position;

(iii) said knife blade mechanism including biasing means for urging said second hinge plate into said first horizontal position;

(e) whereby an extension of paper fed upwardly through said feed slot is inhibited from slipping downwardly therethrough by said retainer mechanism when said rod member is oriented to pinch paper against the slot sidewall; and, (f) whereby said knife blade mechanism, in operation, will leave an extension of paper projecting upwardly from said countertop work surface, when operated to cut paper fed from said roll by use of said second hinge plate knife blade in said vertical cutting position.

6. An arrangement according to claim 5 wherein said elongate rod member includes friction surface means thereon.

7. An arrangement according to claim 5 wherein said ramp member includes at least one retainer tab thereon constructed and arranged to extend over said rod member to inhibit same from being lifted vertically outwardly from said feed slot.

8. An arrangement according to claim 5 wherein said knife blade includes a serrated knife blade edge.

* * * * *

UNITED STATES PATENT AND TRADEMARK OFFICE

CERTIFICATE OF CORRECTION

PATENT NO. : 4,796,792

DATED : January 10, 1989

INVENTOR(S) : Robert A. Nelson et al.

It is certified that error appears in the above-identified patent and that said Letters Patent is hereby corrected as shown below:

Column 1, line 54, "accomodate" should be --accommodate--.

Column 6, line 36-37, "accomodate" should be --accommodate--.

Column 6, line 39-40, "accomodated" should be --accommodated--.

Column 8, line 50, "biasing" should be --biased--.

Column 9, line 50, "feet" should be --feed--.

Column 9, line 51, "termination" should be --terminate--.

Column 10, line 36, "termination" should be --terminate--.

Signed and Sealed this

Twelfth Day of December, 1989

*Attest:*

JEFFREY M. SAMUELS

*Attesting Officer*

*Acting Commissioner of Patents and Trademarks*